US010087667B2

(12) United States Patent
Girotto et al.

(10) Patent No.: US 10,087,667 B2
(45) Date of Patent: Oct. 2, 2018

(54) FURNITURE ITEM WITH SLIDING LEAF MECHANISM

(71) Applicant: BORTOLUZZI SISTEMI S.P.A, Belluno (IT)

(72) Inventors: Adriano Girotto, Belluno (IT); Rodolfo Dal Castel, Belluno (IT)

(73) Assignee: BORTOLUZZI SISTEMI S.P.A., Belluno (IT)

( * ) Notice: Subject to any disclaimer, the term of this patent is extended or adjusted under 35 U.S.C. 154(b) by 0 days.

(21) Appl. No.: 15/517,170

(22) PCT Filed: Sep. 10, 2015

(86) PCT No.: PCT/IB2015/056944
§ 371 (c)(1),
(2) Date: Apr. 6, 2017

(87) PCT Pub. No.: WO2016/059488
PCT Pub. Date: Apr. 21, 2016

(65) Prior Publication Data

US 2017/0306676 A1 Oct. 26, 2017

(30) Foreign Application Priority Data

Oct. 12, 2014 (IT) ..... TV2014A0146

(51) Int. Cl.
*E05D 15/10* (2006.01)
*E05D 15/06* (2006.01)
(Continued)

(52) U.S. Cl.
CPC ..... *E05D 15/1042* (2013.01); *E05D 3/06* (2013.01); *E05D 15/1065* (2013.01);
(Continued)

(58) Field of Classification Search
CPC . E05D 15/1042; E05D 15/1065; E05D 15/10; E05D 15/06; E05D 15/063; E05D 15/0604; E05D 15/0621
See application file for complete search history.

(56) References Cited

U.S. PATENT DOCUMENTS 5,016,318 A * 5/1991 Harris ..... E05D 15/0608 16/94 R
6,094,866 A * 8/2000 Busnelli ..... E05D 15/1065 49/211
(Continued)

FOREIGN PATENT DOCUMENTS

DE 10200882 A1 7/2003
DE 202011002811 A1 6/2011
EP 0864719 A1 6/1998

*Primary Examiner* — Kimberley S Wright
(74) *Attorney, Agent, or Firm* — Mark M. Friedman

(57) ABSTRACT

A mechanism is described for leaves of a furniture item (10). The furniture item comprises a compartment (V), a sliding leaf (22, 24) to close/uncover the compartment, a mechanism (40) mounted inside the compartment to support the leaf during a horizontal movement in order to uncover the compartment. The mechanism has a support point (48, 58) on the leaf when the leaf is moved to uncover the compartment, wherein the point is displaceable with respect to the furniture item along a direction parallel to the sliding of the leaf, said point being comprised in a rigid element (46, 56) constrained to the compartment.

8 Claims, 2 Drawing Sheets

(51) Int. Cl.
*E05D 3/06* (2006.01)
*E05D 15/56* (2006.01)
*E05D 3/02* (2006.01)

(52) U.S. Cl.
CPC ..... *E05D 15/56* (2013.01); *E05D 2003/027* (2013.01); *E05D 2015/1049* (2013.01); *E05Y 2900/20* (2013.01)

(56) References Cited

U.S. PATENT DOCUMENTS 6,691,462 B2 * 2/2004 Oestermann ..... E05B 65/0876 292/36
7,647,728 B2 * 1/2010 Bortoluzzi ..... E05D 15/10 49/209
8,096,629 B2 * 1/2012 Halfon ..... E05D 15/0652 312/319.7
8,695,165 B2 * 4/2014 Pelekanos ..... E05D 15/26 16/105
8,763,205 B2 * 7/2014 Schmidhauser ..... E05D 15/10 16/92
8,814,282 B2 * 8/2014 Halfon ..... E05D 15/10 312/109
8,950,115 B2 * 2/2015 Andersson ..... E05D 15/1065 312/322
8,984,810 B2 * 3/2015 Bortoluzzi ..... E05D 15/1042 312/139
9,157,264 B2 * 10/2015 Bortoluzzi ..... E05D 15/1042
9,284,761 B2 * 3/2016 Haab ..... E05D 3/04
9,341,011 B2 * 5/2016 Haab ..... E05D 15/0634
9,389,011 B2 * 7/2016 Kim ..... E05D 7/00
2006/0021192 A1 * 2/2006 Gumbau ..... E05D 15/30 16/87 R
2011/0041290 A1 * 2/2011 Herglotz ..... E05D 3/06 16/375
2012/0260460 A1 * 10/2012 Schmidhauser ..... E05D 15/10 16/92
2014/0026488 A1 * 1/2014 Andersson ..... E05D 15/1065 49/210
2014/0082886 A1 * 3/2014 Bortoluzzi ..... E05D 15/1042 16/97
2014/0150208 A1 * 6/2014 Haab ..... E05D 7/0423 16/86.2
2015/0068124 A1 * 3/2015 Fornasari ..... E05D 15/1042 49/130
2016/0066689 A1 * 3/2016 Terno ..... E05D 15/1042 312/298
2016/0312520 A1 * 10/2016 Berger ..... E06B 3/4663
2016/0312521 A1 * 10/2016 Berger ..... E06B 3/4672

* cited by examiner

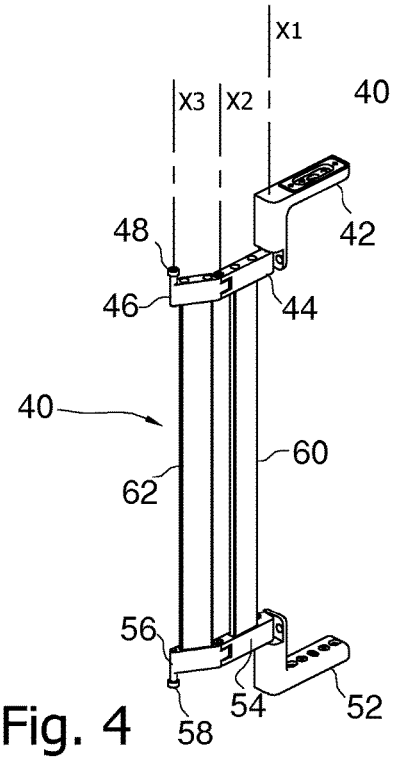
Fig. 4
Fig. 7
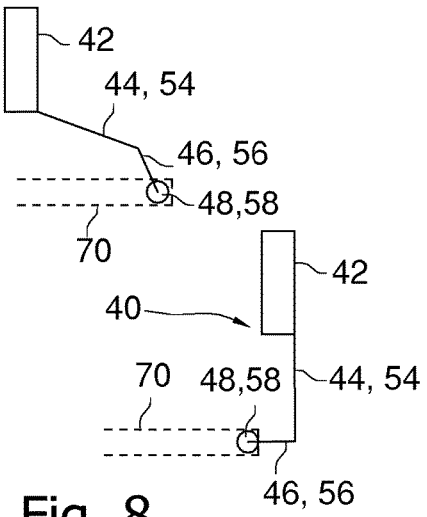
Fig. 8
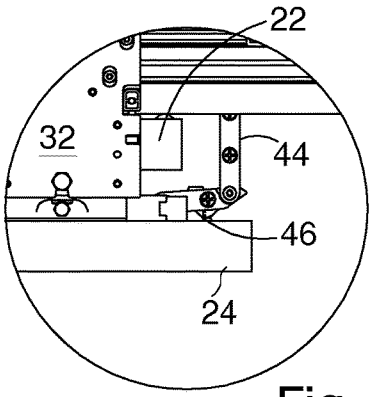
Fig. 9
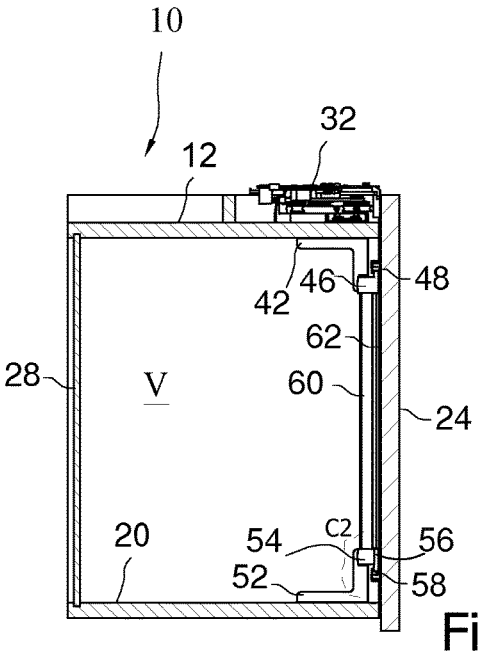
Fig. 5
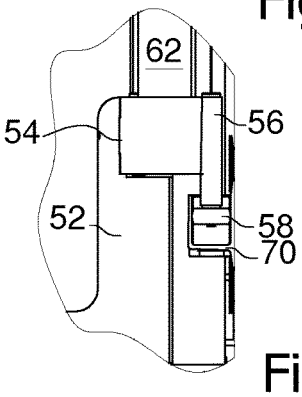
Fig. 6

FURNITURE ITEM WITH SLIDING LEAF MECHANISM

The invention relates to a mechanism for leaves, in particular to a motion system for sliding leaves, and to the furniture item comprising the mechanism.

On some furniture item there are mounted sliding leaves to avoid the disadvantages of the hinged ones, i.e. less closing surfaces for a compartment and bulky opening radii. Each sliding leaf is supported by a pair of brackets connected to carriages with wheels sliding inside a rail, formed in a metal section, arranged on the ceiling and/or on the bottom of the furniture item.

The brackets and the carriages are not sufficient to support and guide the leaf, and a movable arm is added mounted inside the compartment that the leaf closes.

Such arm is extendable linearly, in a direction perpendicular to the leaf, to allow it to get out cantilevered with respect to the furniture item, and has L-shape with a wheel at one end. The L-shape serves to increase the horizontal stroke of the leaf, nonetheless a problem of these systems is that the horizontal stroke is limited by the end-stop imposed by the arm, so much that the compartment cannot be fully opened. Increasing the length of the L's transverse segment increases the opening stroke of the leaf, but the closing one falls. A compromise is chosen, however it is not satisfactory. To move the L-shaped arm it also comprises a rack meshing on toothed wheels. The system is noisy and the movement has several friction caused by the meshing of the toothed wheels on the rack.

To obviate to at least one of these problems is the main object of the invention, which is defined in the appended claims, wherein the dependent ones define advantageous variants.

It is therefore proposed a furniture item comprising a compartment, a sliding leaf to close/uncover the compartment, a mechanism mounted inside the compartment to support the leaf during a horizontal movement in order to uncover the compartment, the mechanism having a support point on the leaf when the leaf is moved to uncover the compartment, wherein the point is displaceable with respect to the furniture item along a direction parallel to the sliding of the leaf, said point being comprised in a rigid element constrained to the compartment.

Allowing the translation of the support point the leaf's end-stop is moved, and the leaf can uncover the compartment more.

Preferably the rigid element comprises a rotatable arm, mounted inside the compartment, for supporting the leaf during a horizontal movement in order to uncover the compartment. It is a simple and robust solution; also it prevents the linear movement of the prior art which restricts the displacement of the support point.

Preferably the rotatable arm comprises a segment or part adapted to be parallel to the leafs sliding direction when the leaf is moved to uncover the compartment, and the arm is hinged to the compartment about—in use—a vertical axis.

In this way the support point can move more by oscillating horizontally.

Preferably, the segment is hinged to the rotatable arm about—in use—a vertical axis. In this way the support point can move even more and maximize the opening stroke of the leaf.

In particular, it is advantageous that said segment is hinged to the rotatable arm so as to be able to rotate to arrange itself parallel to the latter. It is obtained for the leaf the benefit of an end-stop moved a lot towards the opening, even to the side of the compartment's edge.

In particular, and for the same reasons, it is advantageous, in combination or replacement of the previous variant, that said segment is hinged to the rotatable arm in such a way (i) to be able to rotate to arrange itself parallel to the leaf's sliding direction and (ii) with the free end facing the leaf's opening direction.

Preferably, the segment comprises a wheel or rolling element mounted on said free end, the leaf or a guide mounted on the leaf being able to slide on the rolling element.

Preferably the mechanism comprises several rotatable arms, to increase the stability and resistance. In particular, the mechanism can comprise a first pair of parallel arms hinged to the compartment, preferably to the ceiling panel and to the floor panel which delimit the compartment, and a second pair of parallel arms respectively hinged to the first arms. The second pair of arms can take all or some of the variants described for said segment. Preferably the arms of each pair are equal to each other, for minimizing the number of required and stored parts.

Preferably, to increase the strength, one or each pair of arms is connected by a bar or rigid, e.g. straight, member. Preferably, the arms comprise a slot or seat in which to insert one end of the bar or rigid element, or attachment means for the bar or the rigid element.

Preferably, the first arms or the rotatable arm are hinged to the compartment or movable via an anchoring element, e.g. a bracket, e.g. angular. The anchoring element may comprise a base fixable to the furniture item or the compartment and a portion adjustable in position with respect to the base.

The advantage is to adjust the position of the arms when they are mounted and/or coupled to the leaf.

Another aspect of the invention is the isolated mechanism, with which one can equip a generic furniture item or replace those of the prior art.

It is therefore proposed a mechanism for a piece of furniture as above defined, wherein the mechanism is mountable within the compartment to support the leaf during a horizontal movement of its in order to uncover the compartment, the mechanism having a support point on the leaf when the leaf is moved to uncover the compartment, wherein the point is displaceable with respect to the furniture item along a direction parallel to the leafs sliding, said point being comprised in a rigid element constrained to the compartment.

In particular, the mechanism in itself can comprise some or all of the characteristics defined or described here.

E.g. the mechanism

- may comprise a rotatable arm, mounted inside the compartment, adapted to support the leaf during its horizontal movement in order to uncover the compartment; and/or
  - the rotatable arm may comprise a segment or part adapted to arrange itself parallel to the leaf's sliding direction when the leaf is moved to uncover the compartment, and the arm is hinged to the compartment around an axis being—in use—vertical; and/or
  - the segment may be hinged to the rotatable arm around an axis being—in use—vertical; and/or said segment may be hinged to the rotatable arm so as to be able to rotate to arrange itself perpendicular to the latter; and/or said segment can be hinged to the rotatable arm so as to (i) be able to rotate to arrange itself parallel to the leafs sliding direction and (ii) with the free end directed along the leaf's opening direction, and/or the segment may comprise a wheel or rolling element mounted on said free end, the leaf or a guide mounted on the leaf being able to slide on the wheel or rolling on the element, and/or may include several rotatable arms. In particular, the mechanism may comprise a first pair of parallel arms hinged to the compartment, preferably to the ceiling panel and to the bottom panel which delimit the compartment, and a second pair of parallel arms respectively hinged to the first arms. The second pair of arms can assume all or some of the variants described for the said segment.

Preferably the arms of each pair are equal to each other; and/or one or each pair of arms is connected by a bar or rigid element, e.g. straight; and/or the arms comprise a slot or seat in which one end of the bar or rigid element can be inserted, or fixing means for the bar or the rigid element; and/or the first arms or the rotatable arm are hinged to the compartment or the furniture item via an anchoring element, e.g. a bracket, e.g. angular. The anchoring element can comprise a base fixable to the compartment or the furniture item, and a portion adjustable in position with respect to the base. The advantage is being able to adjust the position of the arms when they are mounted and/or coupled to the leaf.

The advantages of the invention will be more apparent from the following description of a preferred embodiment, making reference the attached drawing in which FIG. 1 shows a three dimensional view of a furniture item with closed leaves;

FIG. 4 shows isolated a support mechanism for the leaf;

FIG. 5 shows a cross section according to the plane V-V of FIG. 1;

FIG. 6 shows an enlargement of the hatched area C2 in FIG. 5;

FIGS. 7 and 8 show schematically two configurations of the support mechanism, FIG. 9 shows an enlargement of the dotted circle C1 in FIG. 3.

In the figures, identical numbers indicate identical or conceptually alike parts, and the elements are described as being in use.

Figure 1:
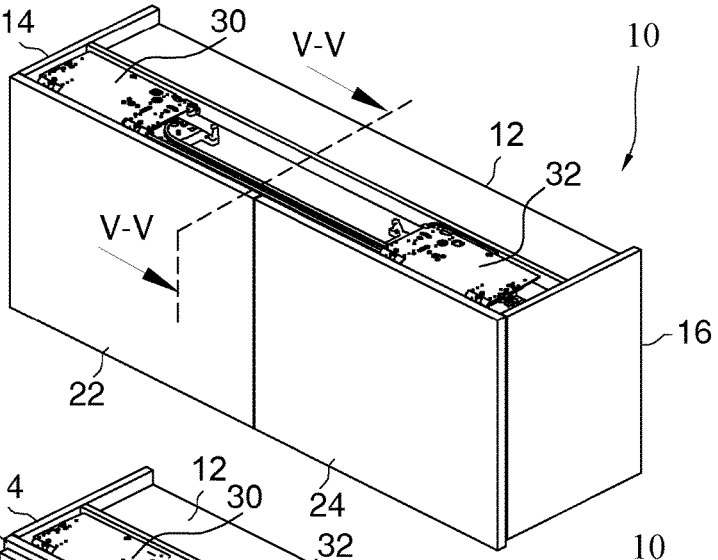

FIG. 1 shows a furniture item 10 comprising a ceiling panel 12, two side panels 14, 16, a bottom 20 and back-panel 28 which delimit a compartment V.

Figure 2:
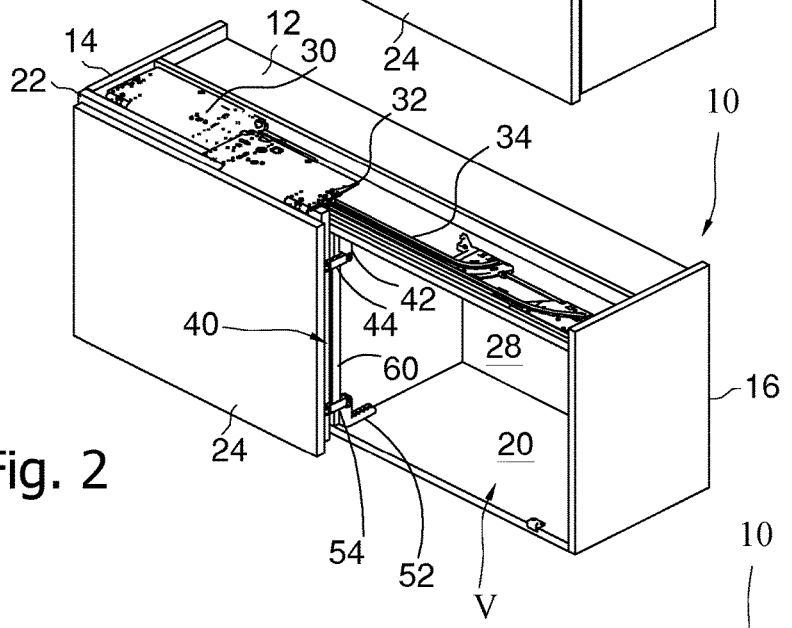
FIG. 2 shows a three dimensional view of the furniture item of FIG. 1 with a leaf open.
Figure 3:
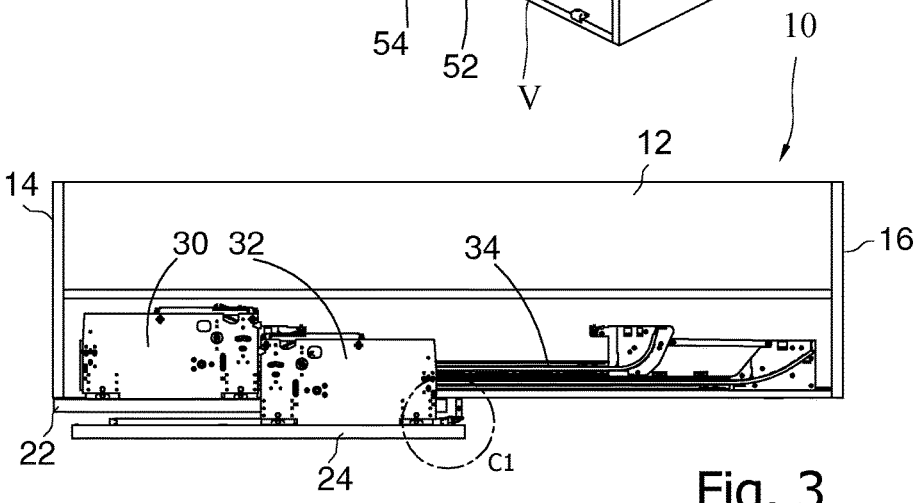
FIG. 3 shows the furniture item of FIG. 2 seen from above.

Two leaves 22, 24, horizontally sliding one with respect to and on the other, can cover (FIG. 1) or uncover (FIG. 2) the compartment V.

Each leaf 22, 24 is supported in known manner by a pair of brackets 30, 32 connected to carriages provided with rollers sliding inside a rail 34, set e.g. on the ceiling panel 12.

For supporting and guiding a leaf 22, 24 there is an articulated mechanism 40 mounted inside the compartment V. For simplicity, we will describe the mechanism only for the leaf 24, since the mechanism may be identical for the leaf 22.

The mechanism 40 (FIG. 4) comprises a pair of first arms 44, 54 hinged to the compartment V around a vertical axis X1 by means of two optional, e.g. angular, brackets 42, 52. The brackets 42, 52 allow the fine adjustment of the axes X1, X2 inside the compartment V.

Preferably, to simplify the kinematics and the construction, the arms 46, 56 and the arms 44, 54 are parallel to each other and straight.

A second pair of parallel arms 46, 56 is hinged, respectively, to the first arms 44, 54 around a vertical axis X2, parallel to X1.

At the end of arms 46, 56 is mounted a wheel 48, 58 with a pivoting axis X3 parallel to X1 and X2. The wheel 48, 58 can slide inside a complementary guide 70 mounted on the inner side of the leaf 24 (FIG. 6); therefore, the leaf 24 can be moved relatively to the mechanism 40 without breaking away.

To give greater rigidity to the mechanism 40, preferably the arms 44, 54 are connected by a bar 60, and/or the arms 46, 56 are connected by a bar 62. For example, the arms 44, 54 and the arms 46, 56 may have on the side facing the other arm a groove or cavity in which to insert the end of the bar.

Operation

To move the leaf 24 and discover the compartment V, it is enough to just pull the leaf 24 towards the outside of the furniture item 10. The leaf 24, supported by the bracket 32 and the mechanism 40, moves away from the furniture item 10, arranging itself more outside than the closed leaf 22. One can then push the leaf 24 to overlap it to the leaf 22.

At rest, with the leaf 24 closed (FIG. 1), the mechanism 40 is configured approximately as in FIG. 7, with the arms 44, 46, 54, 56 turned and directed towards the panel 12 (FIG. 7).

The detachment of the leaf 24 from the furniture item 10 makes the arms 44, 46, 54, 56 slightly rotate toward the opposite panel 14.

Even, during the horizontal sliding of leaf 24 towards and above the leaf 22, the arms 44, 46, 54, 56 rotate slightly toward the leaf closed 22 (to the left clockwise in FIGS. 7 and 8) about the axis X1.

At the end of the stroke of horizontal sliding, the boundary of guide 70 abuts on the wheel 48, 58. Then the rotation of the arms 46, 56 about the axis X1 and the rotation with respect to the arms 44, 54 about the axis X2 increases a lot. Eventually, the arms 44, 54 are approximately orthogonal to the plane of the leaves 22, 24 (or, which is the same, to the back-panel 28) and the arms 46, 56 are substantially orthogonal to the arms 44, 54 (FIG. 8).

The arms 44, 54 and the arms 46, 56 form at this point an L-shaped support, the outer segment of which is parallel to the plane of the leaves 22, 24 (and parallel to the sliding direction of the leaves 22, 24). The articulation with respect to axis X2 between the arms 44, 54 and the arms 46, 56 allows the mechanism 40 to deform and dynamically follow the movement of the leaf 24. In particular, the rotation of the arms 46, 56 with respect to the arms 44, 54 varies the position of the roller 48, 58 when the leaf 24 moves: the wheel 48, 58 can therefore assume two different positions relative to the open/closed position of the leaf 24. Not only one gains length in the stop limit of the open the leaf 24 (the arms 46, 56 may have any length), but the relative displacement (for e.g. the rotation) between the arms 46, 56 and the arms 44, 54 eliminates the design limitations for the length of the outer segment of the said L, because such segment (here the arms 46, 56) moves along with the leaf 24. In fact, with the rigid L-shaped arm of the prior art the support point is fixed relatively to the sliding direction of the leaves and does not go over the opening of compartment V, for which the end-of-travel stop is inherently determined.

With the arms 46, 56 also moves the wheel 58, 48 (i.e. the point of support for the leaf 24). Also, note that the rotation of the arms 46, 56 allows said point of support not only to bypass the central edge of compartment V but also to overlap the other closed leaf 22 (see 10 FIG. 9). Thus the stop limit of leaf 24 widens and/or moves towards the leaf 22, thereby allowing to uncover more the compartment V.

The mechanism has other advantages. E.g. it has increased smoothness, because the arms 44, 46, 53, 56 rotate on and are hinged with pins having relatively small diameter, so the friction that these develop during their rotation is proportionally negligible compared to the length of the levers.

It has higher rigidity, due to the fact that there are no relative plays as in the pinion-rack coupling of the prior art, and to the fact that torsion bars can be used (see. E.g. the bars 60, 62) with very robust section.

Possible variants compared to those already described are e.g.:

the number and form of the leaves;

the use of upper carriages in the guides 34 to move or support the leaves is optional but advantageous. Although the mechanism 40 alone may be able to hold the leaf, in most applications it can only ensure that the leaf 24 remains vertically parallel to the structure of the furniture item 10, or keeps aligned vertically the top and bottom of the leaf 24 by avoiding asymmetries and jams in the carriages 30, 32, especially when the leaf 24 is guided by an upper carriage and a lower one;

the use of a pair of arms 46, 56 and arms 44, 54 is optional, which however improves the rigidity and stability of the support. It could suffice to have a pair of arms 46, 56 or arms 44, 54;

the use of a pair of arms hinged to each other is optional. It could suffice e.g. to have an L-shaped arm with the end hinged to the compartment. However to move the abovementioned support point for the leaf one may also implement other systems, e.g. hinged arms to the compartment around also or only to one or more axes orthogonal to the plane of the leaf (that is, perpendicular to the back-panel 28), electric actuators or drivers, or articulated parallelograms.

The invention claimed is:

1. Furniture item comprising a compartment, a sliding leaf to close/uncover the compartment, the leaf having a stroke of a horizontal movement, the stroke having an end, a mechanism mounted inside the compartment to support the leaf during a horizontal movement in order to uncover the compartment, wherein the mechanism comprises a first arm, which is mounted inside the compartment, for supporting the leaf during a horizontal movement in order to uncover the compartment, and hinged to the compartment about a first vertical axis;

a second arm, which is hinged to the first arm about a second vertical axis, the second vertical axis parallel to the first vertical axis, is adapted to be parallel to the sliding direction of the leaf when the leaf is moved to uncover the compartment, has the free end facing the opening direction of the leaf, and at said free end there is mounted a wheel with a pivoting axis parallel to the first vertical axis and to the second vertical axis, the wheel configured to slide inside a complementary guide mounted on the inner side of the leaf, wherein said first arm and said second arm are mounted so that the rotation of the second arm with respect to the first arm varies the position of the wheel when the leaf moves, the wheel thereby assuming two different positions relative to the open/closed position of the leaf, and at the end of the stroke of the horizontal movement of the leaf, the horizontal movement being a sliding movement, the first arm is approximately orthogonal to the plane of the leaf and the second arm is substantially orthogonal to the first arm thereby forming at this point an L-shaped arm.

2. Furniture item according to claim 1, wherein the mechanism comprises a first pair of parallel arms hinged to the compartment and a second pair of parallel arms respectively hinged to the first pair of parallel arms.

3. Furniture item according to claim 2, wherein the first pair of parallel arms is connected by a rigid element, and wherein the first pair of parallel arms is hinged to the compartment or furniture item via an anchoring element, the anchoring element comprising a base fixable to the furniture item or compartment and a portion adjustable in position with respect to the base.

4. Furniture item according to claim 3, wherein the second pair of parallel arms is hinged to the compartment or furniture item via an anchoring element, the anchoring element comprising a base fixable to the furniture item or compartment and a portion adjustable in position with respect to the base.

5. Furniture item according to claim 2, wherein the first pair of parallel arms is connected by a rigid element.

6. Furniture item according to claim 5, wherein the first pair of arms comprises a seat in which to insert one end of the rigid element.

7. Furniture item according to claim 2, wherein the second pair of arms is connected by a rigid element.

8. Furniture item according to claim 7, wherein the second pair of arms comprises a seat in which to insert one end of the rigid element.

* * * * *